United States Patent [19]

Hattori

[11] 4,139,356

[45] Feb. 13, 1979

[54] REFRIGERATING APPARATUS

[75] Inventor: Kiyoshi Hattori, Aomori, Japan

[73] Assignee: Taisei Kogyo Kabushiki Kaisha, Aomori, Japan

[21] Appl. No.: 855,922

[22] Filed: Nov. 30, 1977

[30] Foreign Application Priority Data

Dec. 6, 1976 [JP] Japan ..... 51-145562
Oct. 24, 1977 [JP] Japan ..... 52-141843

[51] Int. Cl.[2] ..... F25B 47/00; F25B 43/00
[52] U.S. Cl. ..... 62/278; 62/503
[58] Field of Search ..... 62/196 R, 278, 503

[56] References Cited

U.S. PATENT DOCUMENTS

| | | | |
|---|---|---|---|
| 3,246,482 | 4/1966 | Harnish | 62/503 |
| 3,388,558 | 6/1968 | Harnish | 62/196 R |
| 3,609,990 | 10/1971 | Bottum | 62/503 |
| 4,009,596 | 3/1977 | Morse | 62/503 |
| 4,041,728 | 8/1977 | Morse et al. | 62/503 |
| 4,083,195 | 4/1978 | Kramer et al. | 62/278 |

*Primary Examiner*—Lloyd L. King
*Attorney, Agent, or Firm*—James E. Nilles

[57] ABSTRACT

A refrigerating apparatus comprising a refrigerating cycle and a defrost cycle. Said refrigerating apparatus comprising a refrigerant compressor, a radiator being connected at an inlet port thereof to an outlet spouting port of said compressor, a condenser being connected at an inlet port thereof to an outlet port of said radiator, a receiver being connected at an inlet port thereof to an outlet port of said condenser, a cooler being connected at inlet port thereof to an outlet port of said receiver, with an expansion valve being mounted between them, a water tank in which said radiator is dipped, and an accumulator being dipped in said water tank.

5 Claims, 6 Drawing Figures

REFRIGERATING APPARATUS

This invention relates to an improvement in the refrigerating apparatus in which such refrigerant as ammonia, freon etc. is circulated.

Generally, in the case of this type of refrigerating apparatus, the moisture in the air frosts during the refrigerating cycle on surfaces of cooling pipes and fins which construct each cooler element of refrigerator and the layer of frost (or snow) grows which develops thickly as time goes by. Since this layer of frost deteriorates the cooling efficiency remarkably, it is necessary that this frost is defrosted. Heretofore, many prior arts to defrost have been arranged but none of them are satisfactory as yet because their defrosting is low efficient and takes too long defrosting time.

Under the circumstances, the object of this invention is to offer a refrigerating apparatus having a defrosting system which enables the highly efficient defrosting perfectly in a short time by means of feeding the refrigerant of high in calories are relatively high temperature into the cooler.

Additional objects as well as features of this invention will become evident from the description set forth hereafter when considered in conjunction with explanations of accompanying drawings, in which;

FIG. 2 (b) is, in relation to FIG. 2(a), a drawing of curves showing the change of pressure and speed of refrigerant in the ejector;

Figure 1:
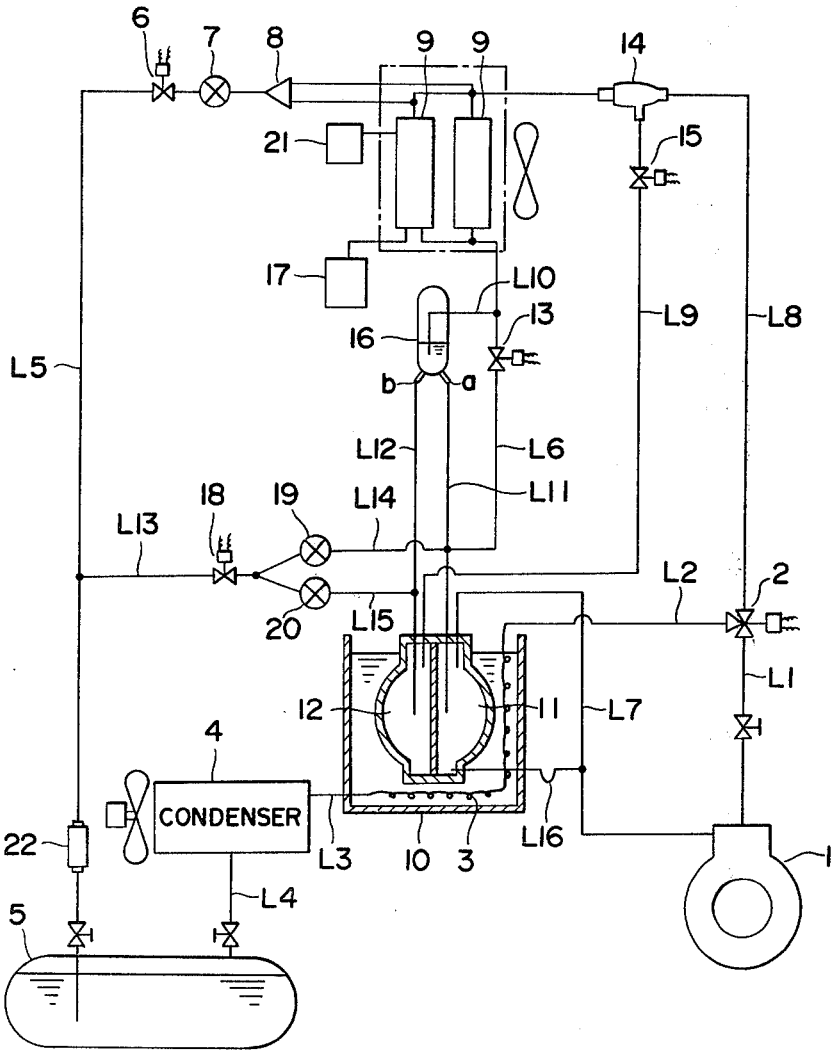
FIG. 1 is a view in explanation of one embodiment of the refrigerating apparatus of this invention.

In this invention, as shown in FIG. 1, a line L1 is connected at one end thereof to outlet spouting port of a compressor 1 and connected at the other end thereof to an inlet port of a three-way valve 2, to a first outlet port of which an inlet port of a radiator 3, as mentioned hereafter, is connected through a line L2. A line L3 is connected at one end thereof to an outlet port of said radiator 3 and connected at the other end thereof to an inlet port of a condensor 4, to outlet port of which an inlet port of a receiver 5 is connected through a line L4. In a line L5 extending from an outlet port of the receiver 5, a valve 6, an expansion valve 7 and a distributor 8 are mounted in series in said order and each outlet port of distributor 8 are connected respectively to inlet ports of each cooler element 9 which constructs a cooler.

On the other hand, a water tank 10 made of heat insulating material is provided and is filled with water in which said radiator 3, a first accumulator 11 and a second accumulator 12, both made of heat conducting material, are dipped. The first accumulator 11 and second accumulator 12 can be formed separately but can also be formed in one container with a partition wall which divides two accumulators each other. Said radiator 3 can be formed, for example, by winding a part of one metal pipe in coil form.

A line L6 is connected at inlet end thereof to outlet port of each cooler element 9 and inserted at outlet end thereof into inside of first accumulator 11. A valve 13 is mounted in line L6. A return line L7 having inlet end thereof inside of upper portion of said first accumulator 11 is connected at outlet end thereof to inlet suction port of said compressor 1.

A line L8 is connected at one end thereof to a second outlet port of said three-way valve 2 and connected at the other end thereof to inlet port of an ejector 14, outlet port of which is connected to each inlet port of cooler element 9. A line L9 is inserted at inlet end thereof into upper portion of inside of said second accumulator 12 and connected at outlet end thereof to the negative pressure port of said ejector 14. A valve 15 is mounted in said line L9. A line L10 branched off from the upper stream of valve 14 which is mounted on the halfway of line L6 which extends between outlet port of said cooler element 9 and inside of first accumulator 11, is connected to inlet port of a trap 16. Two orifice outlets a and b which have different diameters are formed at the bottom of the trap 16 and a line L11 is connected at one end thereof to the orifice outlet a and inserted the other end thereof into inside of said first accumulator 11. A line L12 is connected at one end thereof to the orifice outlet b and inserted the other end thereof into inside of said second accumulator 12.

Said three-way valve 2, valves 6, 13, and 15 are to be constructed by electromagnetic valves and are to be controlled interlockingly by a suitable controlling structure. For said controlling, a timer, for an example, which sends a starting signal to defrost at regular intervals or a defrosting switch 17, for another example, which automatically detect the volume of snow grown on cooler element 9 and controls start or stop of defrosting cycle, can be adopted. In the meantime, 21 is a pressure switch and 22 is a refrigerant dryer.

The operation of refrigerating apparatus of this invention constructed as aforementioned will now be explained.

During the ordinary refrigeration cycle, first outlet port of three-way valve 2 is opened, second outlet port thereof is closed and valves 6 and 13 are opened and valve 15 is closed. Under this condition, the gasified refrigerant of high temperature is introduced from spouting port of compressor 1 into radiator 3 through line L1, three-way valve 2 and line L2, giving the heat to water in water tank 10 on passing therethrough, and then proceeds through line L3 into condenser 4 where the gasified refrigerant is turned to liquid by being absorbed its heat. This liquid refrigerant is kept in receiver 5 through line L4. Said liquid refrigerant in receiver 5 is then introduced through line L5 and passes valve 6 into expansion valve 7 and cooled by being expanded therein and is introduced through distributor 8 into each cooler element 9 where refrigerating cooling is taken place. The refrigerant which passed cooler elements 9 then passes valve 13 and is introduced through line L6 into first accumulator 11.

In the meantime, the temperature inside of said first accumulator 11 is considerably higher than the refrigerant introduced into accumulator 11 because the heat from said radiator 3 is conveyed by water in water tank 10. Therefore, the liquid portion contained in refrigerant having been introduced through said line L6 is evapolated and becomes complete gaseity. After all, all the refrigerant introduced into accumulator 11 become completely gasified refrigerant and this gasified refrigerant is sucked into inlet suction port of compressor 1 through return line L7.

In the above formation, a part of heat of refrigerant of high temperature introduced from compressor 1 is absorbed in radiator 3 before it is absorbed in condenser 4. Since the heat absorbed in radiator 3 is utilized for the complete gasification of refrigerant which has been introduced from cooler elements 9, condenser 4 can be formed in a small capacity.

Next, during defrosting cycle, by switching three-way valve 2, first outlet port thereof is closed, second outlet port thereof is opened and at the same time, valves 6 and 13 are closed and valve 15 is opened. Thus, first and second cycle actions for the next defrosting start. During the first cycle action, the gasified refrigerant of high temperature from spouting port of compressor 1 is introduced through line L1, three-way valve 2 and line L8 into inlet port of ejector 14 and is, by second cycle action, as mentioned hereafter, spouted into each cooler element 9 from outlet port of ejector 14 together with the gasified refrigerant of relatively high temperature which has been introduced from negative pressure suction port of ejector 14. By the above actions, each cooler element 9 is heated and can defrost the snow grown on surface thereof. The gasified refrigerant which has been spouted into each cooler element 9 is cooled, becomes liquid and drops from outlet port of cooler element 9 through a part of line L6 and line L10 into trap 16 and is kept therein temporarily. Whenever said refrigerant is accumulated in trap 16, it flows out from orifice outlets a and b in different volume according to their diameters and also in different pressure which have been reduced according to different diameters. The refrigerant from orifice outlet a is introduced through line L11 into first accumulator 11 and after being gasified by surrounding heat therein, returns through return line L7 into compressor 1. First cycle action is thus maintained.

Now, during second cycle action, the refrigerant from orifice outlet b of said trap 16 is introduced through line L12 into second accumulator 12 wherein it is heated and is gasified completely. As stated above, into said ejector 14, the refrigerant of high temperature and high pressure has been spouted from spouting port of compressor 1 through lines L1 and L8 by the first cycle action. At negative pressure suction port of ejector 14, a suction power is exsisting by the speed energy of said spouting stream. By said suction power, the gasified refrigerant which has become relatively high temperature in said second accumulator 12 is sucked into negative pressure suction port of ejector 14 through line L9 and passing through valve 15 and join there with the refrigerant which has come from said inlet port of ejector 14 and is then spouted into cooler elements 9 together. Second cycle action is thus maintained.

Figures 2A, 2B:
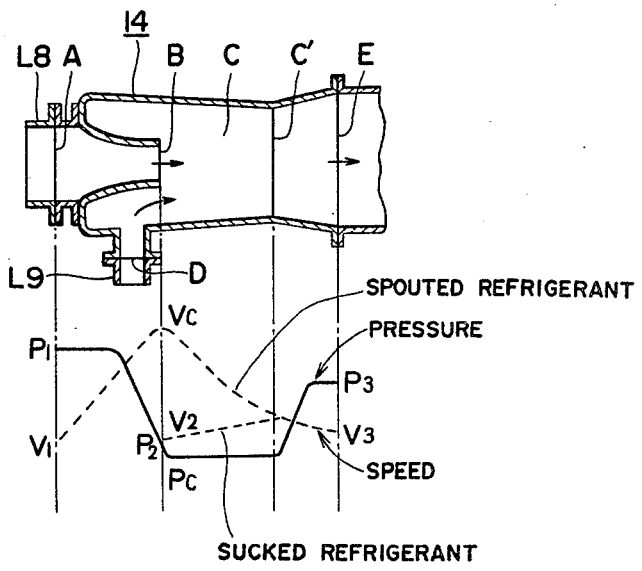
FIG. 2 (a) is a view in explanation of the ejector.

The effect of ejector 14 during two kinds of cycle actionis as follows:

As shown in FIGS. 2 (*a*) and (*b*), supposing that the refrigerant from line L8 flows into inlet port A of ejector 14 in a ratio of pressure $P_1$, speed $V_1$ and rate of flow $G_1$, said flowed refrigerant is then spouted into mixing room C after dropping pressure $P_1$ thereof to critical pressure $P_c$ or less than that and increasing speed $V_1$ thereof to critical speed $V_c$ or more than that while passing spouting outlet B. Supposing that the refrigerant is, by energy of said spouting speed, sucked from line L9 through negative pressure suction port D in a ratio of pressure $P_2$ and rate of flow $G_2$, said sucked refrigerant is mixed thoroughly with the refrigerant from said spouting outlet B in mixing room C before reaching throat portion $C_1$ thereof and is therefore compressed by the speed energy of refrigerant from spouting port B and after all, the mixed refrigerant is spouted into cooler elements 9 from outlet port E with speed $V_3$ after becoming pressure $P_3$ which is lower than $P_1$ and higher than $P_2$. Rate of flow of this spouted refrigerant is $(G_1 + G_2)$ and the defrosting of cooler is executed by enthalpy being kept by said refrigerant.

Namely, the energy thrown into compressor 1 during first cycle action is converted to heat energy and speed energy and said heat energy as it is is utilized for defrosting and, at the same time, the heat energy of refrigerant which has been sucked from second accumulator 12 by aforesaid speed energy is utilized for defrosting. The defrosting can be, therefore, accomplished very efficiently. When the refrigerant from compressor 1 is spouted directly into cooler elements 9 without passing ejector, the rate of flow of said refrigerant is merely $G_1$. Also in said case, the refrigerant is spouted into cooler elements 9 with no other than spouting pressure $P_1$ of compressor 1. On the other hand, in the case of this invention, said refrigerant is spouted into cooloer element with pressure $P_3$ which is lower than $P_1$ and is, therefore, very safe for practical use. The condition of refrigerant in the ejector when freon 22, for example, is used as refrigerant was as follows:

$P_1 = 14$ Kg/cm$^2$ (Absolute pressure)
$P_c = 7.97$ Kg/cm$^2$ (Absolute pressure)
$P_2 = 8.1$ Kg/cm$^2$ (Absolute pressure)
$P_3 = 9.62$ Kg/cm$^2$ (Absolute pressure)
$V_c = 170$ m/sec
$V_3 = 50$ m/sec At this consition, the temperature of refrigerant at inlet port A, at spouting outlet B and at outlet port E were 35° C., 14.5° C., and 21.0° C. respectively.

Under the above formation, if a suitable iris structure which acts only during defrosting cycle is mounted in line L6 in place valve 13, the orifice outlet a of trap 16 and line L11 can be eliminated. As for said iris structure, a differencial pressure valve consisting of a main line having a valve therein and a bypass line, for example, can be adopted. Also, in place of trap 16 which has two orifice outlets, two traps each of which has one orifice outlet of different diameter may be installed in parallel.

By the aforesaid embodiment of refrigerating apparatus, the necessary defrosting of very high efficiency can be accomplished safely and economically during the defrosting cycle. However, right after having shifted from refrigerating cycle to defrosting cycle, the volume of refrigerant which to be introduced from said trap 16 into each accumulator 11 and 12 is small because the pressure in cooler element 9 does not rise immediately. As a result, it takes a considerably long time until said highly efficient defrosting is commenced, namely, until the pressure in cooler element 9 rises to the equal level to the spouting pressure of ejector 14. Consequently, it takes a long time until defrosting is completed and the temperature of refrigerating space is feared to rise. In order to solve such problem as above, this invention branches off a line L13 from the line L5 which is extending from outlet port of said receiver 5 and couples valve 18 in line L13. Furthermore, a line L14 is branched off from the line L13 and is inserted outlet end thereof into inside of the first accumulator 11. Another line L15 which also branches off from line L13 is inserted the outlet end thereof into inside of the second accumulator 12. Rated pressure expansion valves 19 and 20 are coupled in the lines L14 and L15 respectively.

By such a formation, when the pressure in cooler element 9 is low, inside of both accumulators 11 and 12 are also low pressured. Therefore, if valve 18 is opened at the same time to the shifting to defrosting cycle, rated pressure expansion valves 19 and 20 are opened by the pressure difference. Until said pressure difference drops to the pre-designated value at said rated pressure expansion valves 19 and 20, the refrigerant in said receiver 5 is introduced immediately through line L13 and succeeding lines L14 and L15 into first accumulator 11 and second accumulator 12 respectively. Consequently, the necessary volume of refrigerant can be supplied in order that said first and second cycle actions are executed satisfactorily right after shifting to the defrosting cycle. As a result, the highly efficient defrosting is commenced immediately and the time necessary to complete defrosting can be reduced remarkably. Needless to say, it is possible to adopt an electromagnetic valve as said valve 18 and to control it interlockingly with other electromagnetic valves 15 etc. Also other types of expansion valve can be adopted in place of rated pressure expansion valves 19 and 20.

Next, the switching action of each cycle in refrigerating apparatus of this invention will be explained. The switching from refrigerating cycle to defrosting cycle can be made as mentioned before, by means of opening second outlet port of three-way valve 2 by switching thereof, closing valves 6 and 13 and opening valves 15 and 18. These actions are accomplished by defrosting switch 17 furnished with the variable predesignated value which automatically detects the thickness or weight of frost and controls switching, or by the timer which sends the starting signal to defrost at regular intervals.

The switching from the defrosting cycle to refrigerating cycle is accomplished as follows: In case the defrosting switch is adopted, the controlling signal is generated when the frost is removed and the balance returns, and by said controlling signal, three-way valve 2 is switched and first outlet port thereof is opened and valves 15 and 18 are closed. At this time, valves 6 and 13 still remain closed. In case the timer is adopted, the necessary time to defrost is surmised and after said surmised time has been elapsed, said controlling signal is generated. Therefore, at this condition, namely when the switching action of said first stage is finished, the refrigerant from compressor 1 is accumulated in liquid in receiver 5 through radiator 3 and condenser 4. The refrigerant in first accumulator 11 is sucked through return line L7 into inlet suction port of compressor 1. Accordingly, the accumulation of refrigerant in said receiver 5 continues and, at the same time, the pressure in cooler element 9 gradually drops. When said pressure drops to somewhere around pre-designated pressure of pressure switch 21 (sucking pressure of compressor 1 during refrigerating cycle), said pressure switch 21 acts and by the signal thereof, valves 6 and 13 are opened. Thus, the perfect refrigerating cycle starts.

While said shifting to refrigerating cycle completes in a short period, during the period the pressure in cooler element 9 reaches to predesignated pressure of pressure switch 21, the pressure in second accumulator 12 which was at the intermediate pressure during the defrosting cycle, approaches to the pressure of said cooler elements 9 by the action that the refrigerant in accumulator 12 returns in trap 16 through orifice inlet b.

Since only the refrigerant is led out from each accumulator 11 and 12 in gaseity, the refrigerator oil which is used in compressor 1 and circulates with refrigerant, is separately collected in each accumulator 11 and 12. Said oil has to be drained into suction port of compressor 1. A line L16 is used in order to drain said oil from first accumulator 11 into return line L7. By forming a communication opening on the partition wall between first and second accumulators 11 and 12 with a non-return valve being mounted therein, the oil in second accumulator 12 can be drained into line L7 through said line L16.

Figure 3:
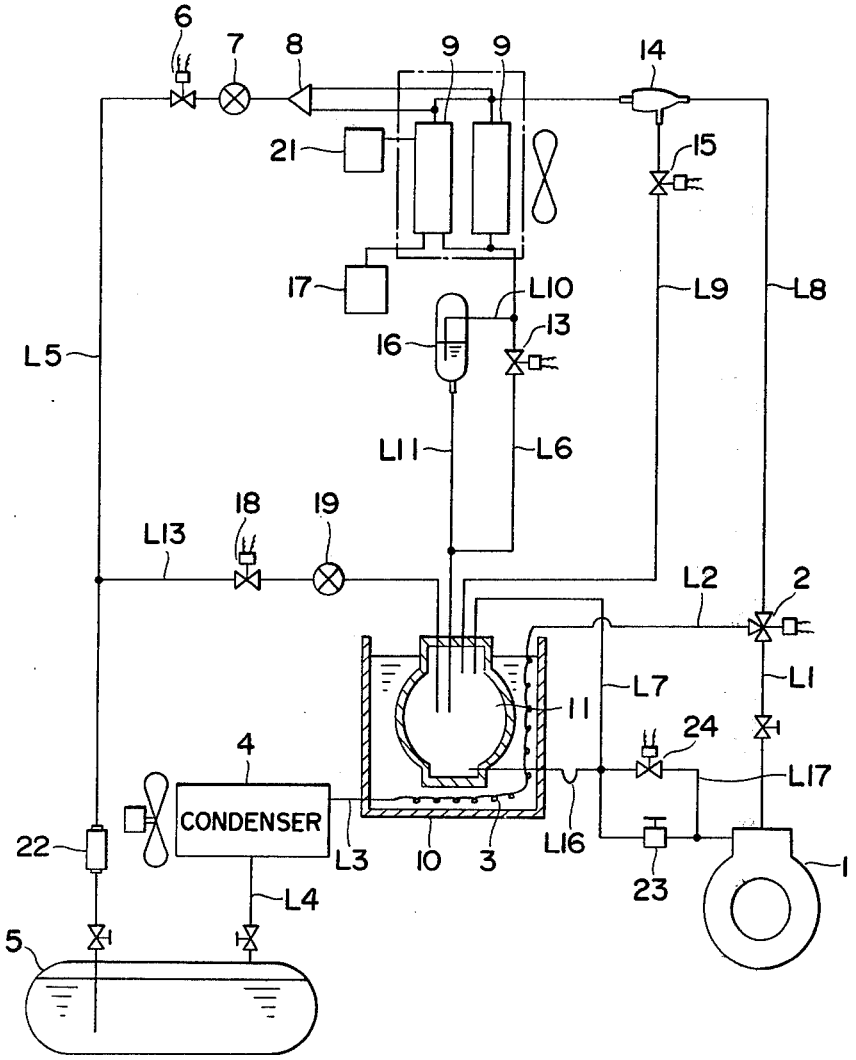
FIGS. 3, 4 and 5 are views in explanation of other embodiments of this invention.

Another embodiment of this invention is shown in FIG. 3. In this embodiment, only one accumulator 11 is formed and a trap 16 has only one orifice outlet. A line L11 is connected at one end thereof to said orifice outlet and inserted the other end thereof into inside of said accumulator 11. A line L13 is inserted outlet end thereof directly into inside of said accumulator 11. A valve 18 and rated pressure expansion valve 19 are mounted in the line L13.

By the above formation, in comparison with the embodiment shown in FIG. 1, one of two accumulators, namely second accumulator 12, lines L12, and L15 and rated pressure expansion valve 20 etc. can be omitted and yet almost equal effect of actions can be obtained. However, in the embodiment shown in FIG. 1, pressure in first accumulator 11 and second accumulator 12 are different like, for example, 4 $Kg/cm^2$ and 8 $Kg/cm^2$ respectively and return line L7 was formed which extends from low pressured first accumulator 11 to inlet suction port of compressor 1. It was not necessarily required, therefore, to mount a suction pressure adjusting valve in said return line L7. On the other hand, in the embodiment shown in FIG. 3, the pressure at inlet end of return line L7 is considerably high. If this high pressure is conveyed directly to inlet suction port of compressore 1, troubles may be caused on compressor 1 as well as on the electric motor which drives the compressor. In this embodiment, therefore, an adjusting valve 23 for reducing the suction pressure is mounted in said return line L7 and also a short circuit line L17 which bypasses both sides of said adjusting valve 23 is formed with a valve 24 being mounted therein. By opening or closing this valve 24 same as valves 6 and 13, the above-mentioned inconvenience can be dissolved.

Figure 4:
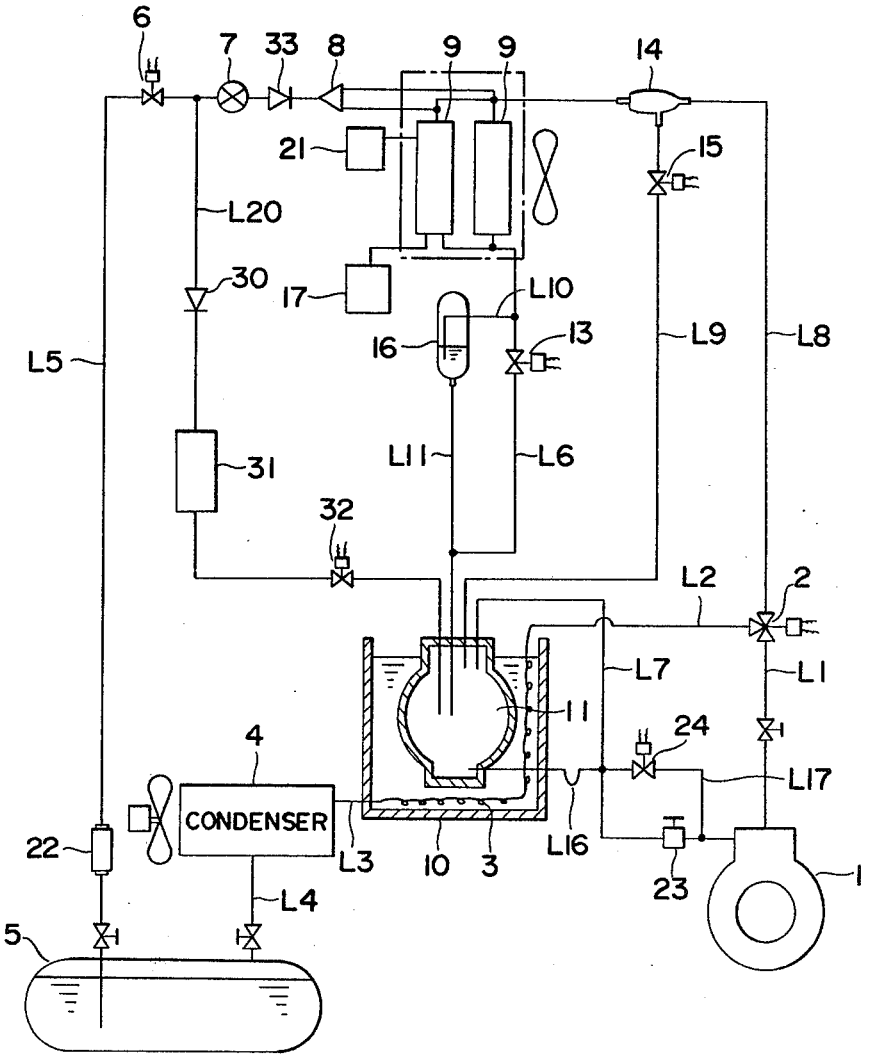

Another embodiment of this invention is shown in FIG. 4. In this embodiment, line L13, valve 18 having been mounted therein and rated pressure expansion valve 19 which were adopted in embodiment shown in FIG. 3 are eliminated and a line L20 is branched off between the valve 6 and the expansion valve 7 from the line L5 which extends from outlet port of the receiver 5. The line L20 is inserted at outlet end thereof into inside of said accumulator 11 and a non-return valve 30, reservoir 31 and valve 32 are mounted therein in said order seeing from branched side. A nonreturn valve 33 is mounted in said line L5 between the expansion valve 7 and the distributor 8. Said valve 32, same as said valve 18, closes and opens together with the valve 15 when valves 6, 13 and 24 open or close in accordance with switching of first and second outlet ports of three-way valve 2.

In this embodiment, therefore, when valve 32 opens at time of shifting to defrosting cycle, the high pressure liquid refrigerant accumulated in reservoir 31 in line L20 flows into low pressured accumulator 11 immediately and the refrigerant in accumulator 11 flows into cooler elements 9 through line L9 and ejector 14. As a result, also in this embodiment, the necessary volume of refrigerant can be supplied immediately after having shifted to the defrosting cycle and therefore, the highly efficient defrosting can be commenced immediately.

Figure 5:
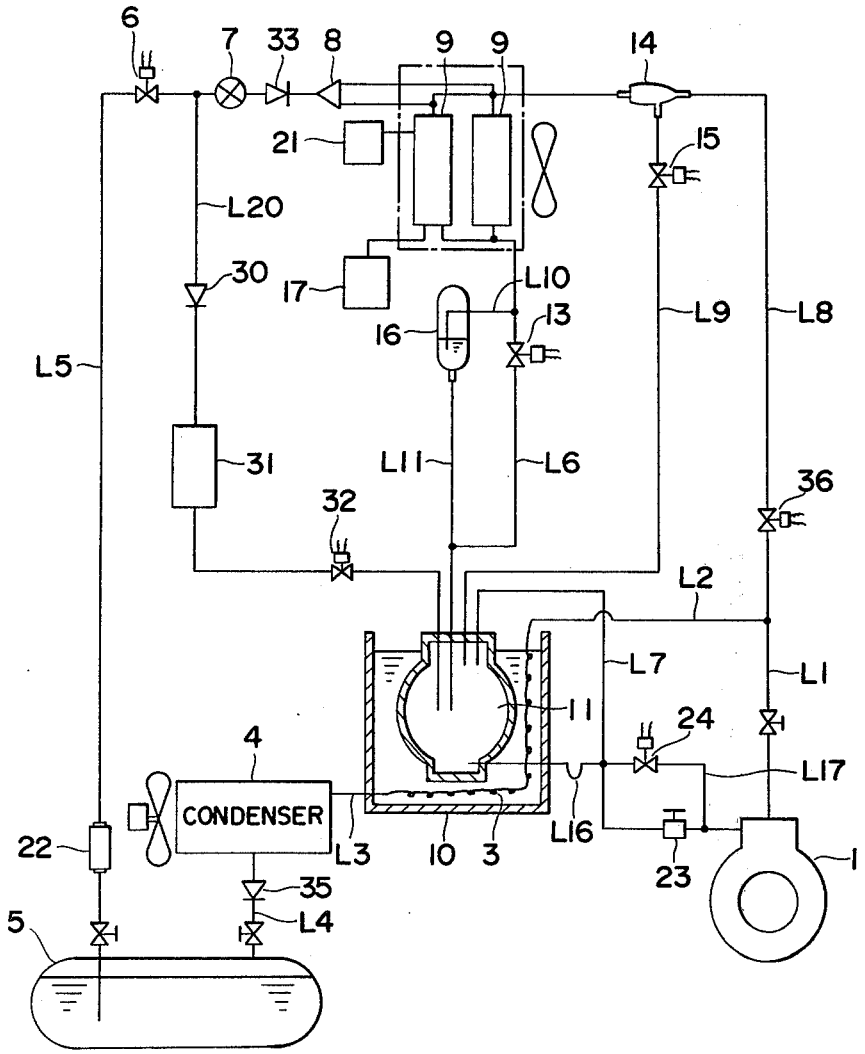

Also in this invention, as shown in FIG. 5, following formation is recommended: Mount a non-return valve 35 at outlet port of the condenser 4 and eliminate three-way valve 2. Also, branch off lines L2 and L8 directly from line L1 and mount a valve 36 in line L8. In such formation, the valve 36 opens during the defrosting cycle only. So, when having shifted to the defrosting cycle, it is possible to introduce the high pressured refrigerant existing between line L2 and non-return valve 35 to line L8 automatically and thus aforesaid effect is improved further. While FIG. 5 is applying the above-mentioned formation to the apparatus shown in FIG. 4, similar formation can also be adopted to embodiments shown in FIGS. 1 and 3. In the meantime, a pressure control valve which reduces pressure as low as such level as required by ejector 14 can be adopted in place of valve 15.

As have been explained in detail, it will be readilly understood that the refrigerating apparatus of this invention has many visible and invisible advantages in very simple formations as follows: The returning refrigerant to the compressor can thoroughly be gasified. During the defrosting cycle, the energy thrown into the compressor can efficiently be utilized for defrosting because the discharged heat which has been collected and accumulated by the accumulator is utilized for defrosting in addition to the heat of refrigerant of high temperature from the compressor. Said defrosting can be commenced immediately. After all, the required defrosting can be accomplished in a very short period surely and safely. The compressor can be operated continuously without stopping during the refrigerating cycle as well as defrosting cycle. Safe and sure actions are executed during each cycle. The extent of application is wide. The running cost can be saved.

What is claimed is:

1. A refrigerating apparatus, comprising a refrigerant compressor, a radiator being connected at an inlet port thereof to an outlet spouting port of said compressor, a condenser being connected at an inlet port thereof to an outlet port of said radiator, a receiver being connected at an inlet port thereof to an outlet port of said condenser, a cooler being connected at inlet port thereof to an outlet port of said receiver, with an expansion valve being mounted between them, a water tank in which said radiator is dipped, an accumulator being dipped in said water tank, a first line being connected at an inlet end thereof to an outlet port of said cooler and being inserted an outlet end thereof into inside of said accumulator, a return line being inserted an inlet end thereof into inside of said accumulator and being connected at an outlet end thereof to an inlet suction port of said compressor, a trap being connected at an inlet port thereof to outlet port of said cooler and having an outlet port of large flowing resistance, a second line being connected at inlet end thereof to outlet port of said trap and being inserted outlet end thereof into inside of said accumulator, an ejector having an inlet port, an outlet port and an inlet suction port and being connected at said inlet port to an outlet spouting port of said compressor, being connected at said outlet port to inlet port of said cooler and being connected at said inlet suction port to inside of said accumulator, a first valve being mounted between an outlet spouting port of said compressor and an inlet port of said ejector, a second valve being mounted between outlet spouting port of said compressor and inlet port of said radiator, said second valve being opened when said first valve is closed, and a third valve being mounted in said first line, said third valve being opened when said first valve is closed.

2. A refrigerating apparatus as claimed in claim 1, further comprising, a third line being connected at an inlet end thereof to outlet port of said receiver and being inserted an outlet end thereof into inside of said accumulator, and a fourth valve being mounted in said third line, said fourth valve being opened when said first valve is opened.

3. A refrigerating apparatus as claimed in claim 1, further comprising, a third line being connected at an inlet end thereof to outlet port of said receiver and being inserted an outlet end thereof into inside of said accumulator, a reservoir being mounted in said third line, and a fourth valve being mounted in said third line at the downstream of said reservoir, said fourth valve being opened when said first valve is opened.

4. A refrigerating apparatus, comprising a refrigerant compressor, a radiator being connected at an inlet port thereof to an outlet spouting port of said compressor, a condenser being connected at an inlet port thereof to an outlet port of said radiator, a receiver being connected at an inlet port thereof to an outlet port of said condenser, a cooler being connected at inlet port thereof to an outlet port of said receiver, with an expansion valve being mounted between them, a water tank in which said radiator is dipped, a first and second accumulators being dipped in said water tank, a first line being connected at an inlet end thereof to an outlet port of said cooler and being inserted an outlet end thereof into inside of said first accumulator, a return line being inserted an inlet end thereof into inside of said first accumulator and being connected at an outlet end thereof to an inlet suction port of said compressor, a trap being connected at an inlet port thereof to outlet port of said cooler and having an outlet port of large flowing resistance, a second line being connected at inlet end thereof to outlet port of said trap and being inserted outlet end thereof into inside of said second accumulator, an ejector having an inlet port, an outlet port and an inlet suction port and being connected at said inlet port to an outlet spouting port of said compressor, being connected at said outlet port to inlet port of said cooler and being connected at said inlet suction port to inside of said second accumulator, a first valve being mounted between an outlet spouting port of said compressor and an inlet port of said ejector, a second valve being mounted between outlet spouting port of said compressor and inlet port of said radiator, said second valve being opened when said first valve is closed, and a third valve being mounted in said first line, said third valve being opened when said first valve is closed.

5. A refrigerating apparatus as claimed in claim 1, further comprising, a third line being connected at an inlet end thereof to outlet port of said receiver and being inserted an outlet end thereof into inside of said first accumulator, a fourth line being connected at an inlet end thereof to outlet port of said receiver and being inserted an outer end thereof into inside of said second accumulator, and valves being mounted in said third and fourth, lines, respectively.

* * * * *